United States Patent [19]

Selenke

[11] Patent Number: 4,513,522

[45] Date of Patent: Apr. 30, 1985

[54] LABEL WITH PARTICULAR APPLICATION TO LABORATORY SPECIMEN CONTAINER IDENTIFICATION

[76] Inventor: William M. Selenke, 18 Gambier Cir., Cincinnati, Ohio 45218

[21] Appl. No.: 418,668

[22] Filed: Sep. 16, 1982

[51] Int. Cl.[3] ..... A44C 3/00

[52] U.S. Cl. ..... 40/2 R; 40/306

[58] Field of Search ..... 40/2 R, 306, 21 R, 21 A, 40/21 B, 21 C, 23, 625, 630, 631, 632

[56] References Cited

U.S. PATENT DOCUMENTS

| | | | |
|---|---|---|---|
| 374,812 | 12/1887 | Sprague | 40/630 |
| 1,994,961 | 3/1935 | Proskauer | 40/632 |
| 3,001,306 | 9/1961 | Wilkinson | 40/2 R |
| 3,001,403 | 9/1961 | Edwards | 40/631 |
| 3,272,532 | 9/1966 | Owen | 40/2 R |
| 3,808,718 | 5/1974 | Christiansen | 40/2 R |
| 3,994,085 | 11/1976 | Groselak et al. | 40/630 |
| 4,112,603 | 9/1978 | Giulie | 40/2 R |
| 4,169,326 | 10/1979 | Reese et al. | 40/306 |
| 4,209,189 | 6/1980 | Betterley | 40/2 R |
| 4,277,902 | 7/1981 | Miniaci et al. | 40/2 R |
| 4,292,749 | 10/1981 | Thomas | 40/23 R |
| 4,312,523 | 1/1982 | Haines | 40/306 |

*Primary Examiner*—John J. Wilson
*Assistant Examiner*—James R. Hakomaki
*Attorney, Agent, or Firm*—Wood, Herron & Evans

[57] ABSTRACT

An improved label is disclosed comprising two semi-rigid cards connected to each other by means of a thin flexible member. Each of the cards has an adhesive portion covered by a release paper and a non-adhesive portion. One end of the flexible member is attached to a respective non-adhesive portion to thereby connect the cards. The adhesive portion and the non-adhesive portion of each card are separable from each other along a perforation which facilitates the disconnection of the cards when desired.

The present invention finds particular application and advantage with laboratory specimen containers. In use, one card is adhesively secured to identifying material, such as a pad of laboratory order slips, and the other card is adhesively secured to a specimen container. The identifying material is thus mechanically attached to the container though in spaced relation thereto by virtue of the flexible interconnecting member. The improved label thereby promotes upright transport of the specimen container as well as assured mechanical association of identifying material with a specific container.

17 Claims, 2 Drawing Figures

LABEL WITH PARTICULAR APPLICATION TO LABORATORY SPECIMEN CONTAINER IDENTIFICATION

FIELD OF THE INVENTION

This invention relates to labels in general, and in particular to labels for laboratory specimen containers.

BACKGROUND OF THE INVENTION

Laboratory specimens primarily consist of samples of human physiological fluids or solids which are submitted to specialized laboratories, such a clinical laboratories, to be examined and tested. Specimens must be labeled and otherwise identified in an unambiguous manner to ensure that the proper tests and analyses are performed on a given specimen and the results properly reported.

In general, it has been the practice to identify a laboratory specimen container with two different labels. One of these labels commonly consists of a paper having a contact adhesive backing with an associated release paper covering the adhesive. This label is ordinarily marked with the patient's name and other identifying information, and placed on a convenient surface of the specimen container. A second labeling means is also employed, this commonly referred to as the laboratory order slip. Such laboratory order slips ordinarily consist of a number of duplicate slips of paper attached at a common end into a pad, and include some means to reproduce information written on the top-most slip in multiple copies on the sheets therebelow. For example, the laboratory slip would ordinarily provide information concerning the patient, as well as directions as to the test to be performed, space for recording the test results, and routing instructions for the test results. Multiple tear-off copies are provided to facilitate record keeping, copies of a slip ordinarily going to the physician, the laboratory doing the testing, an accounting or billing department, etc. Generally, each hospital, laboratory or clinic has its own customized slips.

It is the common practice to simply attach the laboratory slips to the specimen container by means of rubber-bands, common tape, and many times, through the use of the adhesive label previously described.

In larger hospitals, clinics and laboratories, hundreds of specimens may be collected and processed daily. Specimens are ordinarily collected in shallow wide-mouth containers with snap-on or screw-on lids, and in laboratory-type test tubes which may have closures such as rubber stoppers or snap-on or screw-on type lids.

The filled specimen containers are typically allowed to pile up, and are bunched into batches for transport to a preliminary sorting station or directly to the testing area. Specimen filled containers transported in this manner are oftentimes in a jumbled state, with many containers upside-down or on their sides. Although the orientation of the specimen during transport would not ordinarily matter, a significant problem results when one or more of the containers has not been properly closed. For instance, many of the specimens contained in the wide-mouth type containers are ordinarily collected by the patient. Since the general run of such specimens would constitute urine or feces, patients collecting their own specimens may not correctly or firmly secure the top of the container. In other instances, the container itself may be defective.

There are thus numerous instances in which the container leaks thereby soaking the labels of the leaking specimen container as well as other specimen containers in the transported lot, with the result that identifying or directional information is obliterated and other specimens subject to contamination. In addition, those individuals having to handle leaking or leaked upon specimen containers may be exposed to pathological materials, or at the minimum, an unpleasant condition. It consequently follows that if specimen containers were kept in an upright condition during transport, the problem of leakage through such spillage could be substantially eliminated.

The present haphazard system in which laboratories affix the laboratory order slips to the specimen containers does not promote such upright travel, and in fact leads to the jumbled transport previously described. This is largely caused by wrapping or otherwise attaching the relatively bulky laboratory slips directly around the specimen container. Further, laboratory slips haphazardly attached to the specimen containers may become disassociated from a specific container, resulting in additional effort to associate the container with the laboratory slips, and perhaps failure to properly identify a specific container. When identifying information is destroyed or the sample contaminated, some effort will necessarily be required in re-identifying the patient as well as additional effort expended in recollecting the specimen, if possible.

Other problems inherent in the current labeling practice involve difficulties with removing or breaking rubber bands which may be employed as the attaching means, since the the rubber bands can jar loose the cover of the container leading to spillage or contamination.

There is thus a definite need in the industry, and the medical industry in particular, for a label which solves the problems presented by the current system of container labeling, specifically the labeling of laboratory specimens.

SUMMARY OF THE INVENTION

It is a primary object of this invention to provide an improved label. Another object is to provide this label in a form that will substantially insure that identifying and documentary material accompanying a container will remain mechanically associated with the container until separation of the identifying or other documentary material from the container is desired.

Yet another object of the invention is to provide a label that facilitates and promotes the orderly arrangement of containers in an upright orientation during transport to substantially eliminate spillage or leakage.

Yet another object of the invention is to provide a label that is particularly adapted for use with laboratory specimen containers and the order slips accompanying those same specimen containers.

Yet a further object of the invention is to provide a perforated label element for an improved label which can be employed to identify a test-tube type specimen container and serve the collateral function of further securing any closure used with the test-tube type specimen container, the perforation facilitating removal of the closure when desired.

These and other objects have been accomplished by this invention in an improved label which comprises two label elements joined in spaced apart relation by an inter-connecting member. One of the label elements has a front and a back, with the back having an adhesive and a non-adhesive portion. The adhesive portion of this label element is affixed to a container, with identifying indicia and/or other documentary material displayed on the other label element or on both label elements, as desired. By using a flexible, relatively thin material for the first label element, such as a relatively small and thin piece of paper or paperboard, the first label element can be adhesively secured to the container in a manner to roughly conform to the surface configuration of the container. Since the second label element is connected to the first label element in spaced apart relation by the inter-connecting member, such as a piece of string or rubber band, the second label element will consequently not interfere with the arrangement of the container in a grouping of containers for transport. The second label element may consequently be relatively bulky in size or form.

In a preferred form of this invention, the improved label comprises two semi-rigid paper cards, or first and second label elements, that are inter-connected by a suitable length of thread or string. Both of the generally rectangular label cards have a front and a back, with the back of each card divided into an adhesive portion and a non-adhesive portion. A contact adhesive covered by a release paper is provided for. It has been found advantageous to embed the inter-connecting thread or string in the non-adhesive portion of the cards, although it will be recognized that any kind of attachment for the inter-connecting member will suffice.

The cards are additionally perforated, a perforation separating the adhesive from the non-adhesive portion of the card, to thereby facilitate separation of the two portions when desired. In addition, the first label card has a longitudinal perforation line extending across the adhesive portion.

In use, identifying data may be written on the first label card, the release paper thereupon removed and the label card adhesively affixed to a container, such as a laboratory specimen container. The second label card with its release paper removed is attached to other documentary information or material, such as the laboratory order slips ordinarily employed in the collection and testing of laboratory specimens. As previously stated, these laboratory slips commonly include a plurality of duplicate papers joined at a common end into a pad, and contain identifying data, test instructions, routing direction, etc. The second label card is simply folded around the common end of the pad in a manner so as not to obstruct removable of slips from the pad when desired.

With the identification of the container accomplished in the foregoing manner, it is thus apparent that the improved label of this invention provides for the orderly arrangement of the containers in an upright orientation, since the generally bulky order slips are not directly affixed to the container but rather are mechanically associated by virtue of the inter-connecting thread or string, permitting the order slips to be set at any convenient location nearby the container or to otherwise hang loosely.

The perforation separating the adhesive from the non-adhesive portions permits the disassociation of one or both non-adhesive portions of the label cards when desired, such as when the container has reached its ultimate destination. Additionally, the longitudinal perforation extending across the adhesive portion of the first label card permits this label element to perform a collateral function as an additional securing means for a container lid on the container. For example, an ordinary test tube type specimen container will have a stopper, snap-on cap or similar closure. This closure can be further secured to the container by wrapping the adhesive portion of the first label card around the test tube with the longitudinal perforation approximately following the line of demarcation between the closure and the test tube body. When it is desired to open the test tube type specimen container with the first label card so attached, the non-adhesive portion is separated from the remainder of the label card, and the adhesive portion of the card broken along the perforated line, such as by a simple twist of the closure.

In ordinary practice, laboratory order slips are customized for use, and will generally vary from one organization to another. Consequently, the above-described second label element or card is particularly adapted so as to secure any such order slip or indeed, any documenting material to be carried with a container. It will of course be recognized that this invention encompasses the use of the second label element as additional identification and/or documentary material in and of itself, either in the form of a single sheet without any adhesive thereon, or a plurality of papers joined at a common end into a pad similar to the order slips heretofore described.

The foregoing objectives, features and advantages of the present invention will be more readily understood upon consideration of the following detailed description of the invention taken in conjunction with the accompanying drawings, in which:

DETAILED DESCRIPTION OF THE INVENTION

Although the following detailed description of a preferred form of the invention is made with regard to a particular application of the invention in the labeling of specimen containers ordinarily employed in hospitals, laboratories, clinics, and the like, it will be understood that the improved label of this invention has general application where it is desired that identifying indicia, data or other documentary material is to accompany an object, such as a container, in a manner where the identifying material is mechanically associated with the object yet retained in spaced relation to the object to thereby facilitate stacking or transport thereof.

Figure 1:
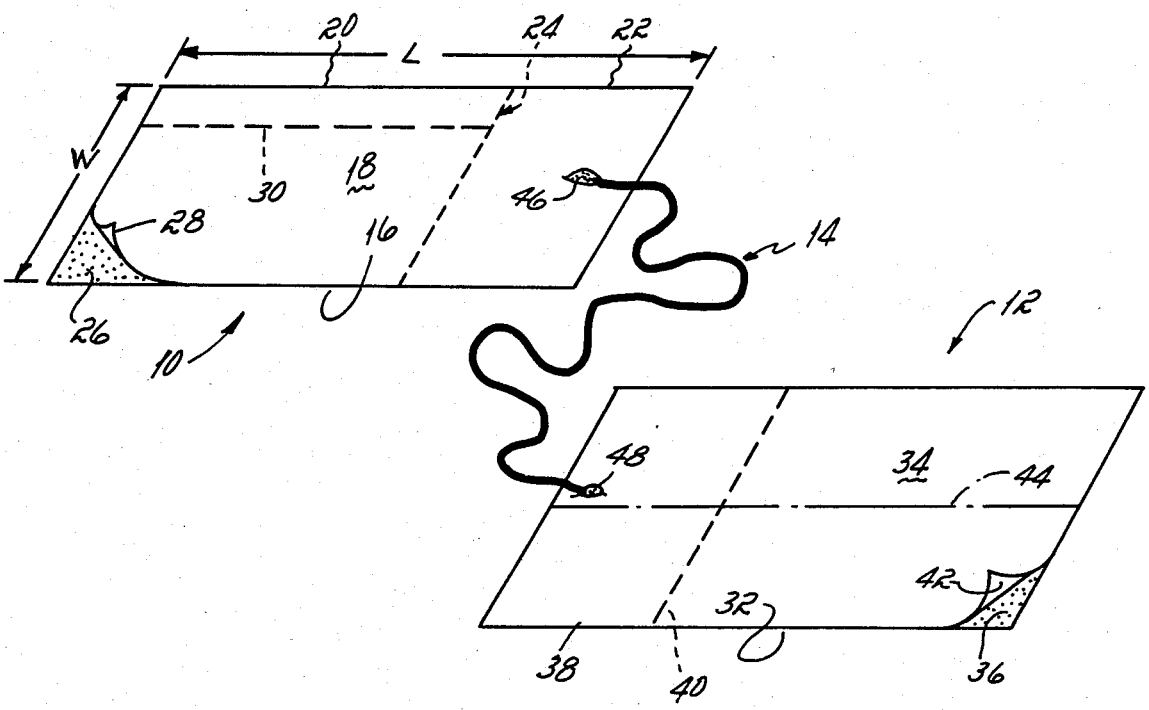
FIG. 1 is a plan view of an improved label made in accordance with the principles of this invention.

With reference now to FIG. 1, the improved label of this invention comprises a first label element 10 and a second label element 12 which are mechanically joined together by an inter-connecting member 14. The first and second label elements 10 and 12 respectively, may be made of any suitable material; for instance, it has been found advantageous to make both of these elements out of paper such as a semi-rigid paperboard to promote writing thereon and to make the labels relatively inexpensive to produce.

The label elements are both made in the same generally two dimensional rectangular shape in this preferred form. For example, label elements having a longitudinal length L of approximately 3½ inches and a width W of about 1½ inches are of an appropriate size to meet the objectives of this invention as well as facilitate manipulation of the individual label elements. The first label element 10 has a front or face 16 and a rear or back 18. The first label element 10 is divided into two generally rectangular and adjacent portions 20 and 22 by the perforation line 24, which extends completely through the label element and across the width at a point spaced inwardly from one end. Label element portion 20 is provided on the back with an appropriate adhesive, preferably a contact adhesive, as here 26. A release paper 28 covers the the contact adhesive and is easily removed along the back by virtue of the perforation 24. An additional perforation 30 extends longitudinally across the adhesive portion 20 to facilitate separation of the adhesive portion along this line in a manner to be further described below.

The other portion 22 of the label element 10 is preferably not provided with any adhesive inasmuch as this portion of the label element will not be adhered to any object, such as a specimen container.

The second label element 12 is similar in structure and composition to that of the first label element 10. The label element 12 has a front 32 and a back 34, with the back 34 divided into an adhesive portion 36 and a non-adhesive portion 38 by perforation line 40. The perforation line 40 extends through and across the width of the second label element along a line spaced inwardly from one end of the label element. A release paper 42 covers the adhesive portion 36.

A crease line 44, which may also be a perforation line, extends longitudinally across the length of the second label element 12. The crease line 44 facilitates folding of the label element 12 such that the adhesive portion 36 may be affixed to both the front and back of material which is desired to be carried along with the label element, such as where one or more pages of identifying or documentary material are to be attached to the label element; in this regard, the affixation of the second label element 12 to a pad of laboratory order slips will be more fully discussed below.

The first and second label elements 10 and 12, respectively, are mechanically joined together through the use of an inter-connecting member 14. The inter-connecting member 14 may consist of a flexible piece of thread, such as common heavy sewing thread, monofiliment line, or a length of thin elastomeric material similar to the common rubber band. The inter-connecting member 14 has two ends, one end 46 being carried by the non-adhesive portion 22 of the first label element 10, and the other end 48 being carried by the non-adhesive portion 38 of the second label element 12. For example, the ends 46 and 48 may be embedded in the non-adhesive ends of the label elements and secured, such as by gluing, or simply tied through holes provided in the respective non-adhesive ends to thereby connect the two label elements.

Figure 2:
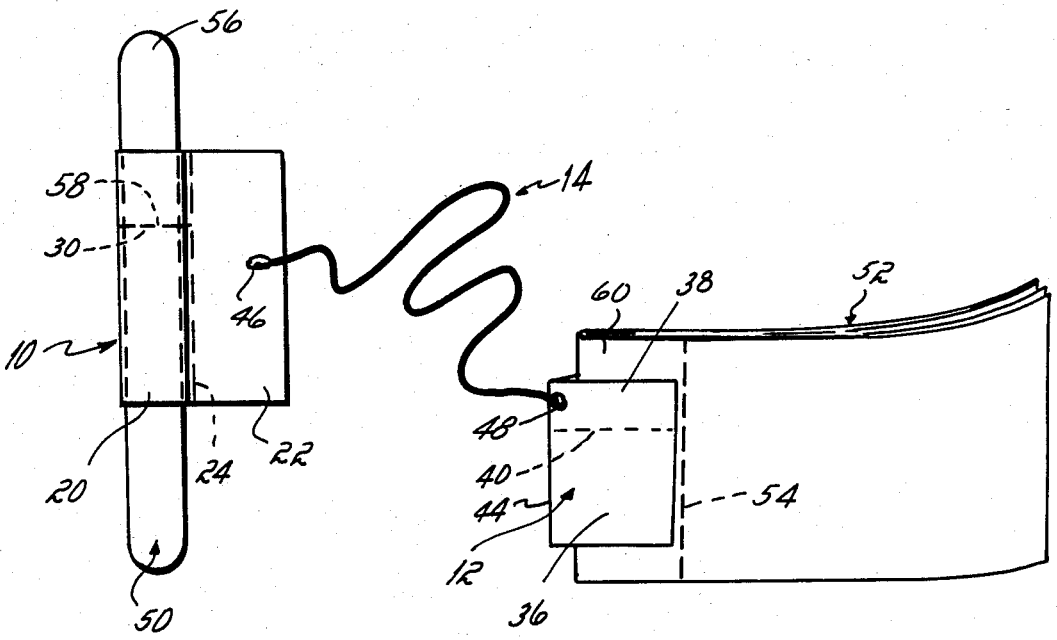
FIG. 2 is a perspective view of the label illustrated in FIG. 1 in operative association with a test tube type container and a pad of laboratory order slips.

With reference to FIG. 2, the aforedescribed improved label is shown in operative association with a standard test tube type specimen container 50 and a plurality of duplicate sheets of paper joined at a common end in the form of a pad 52, such as a hospital order slip. In general, such an order slip pad will convey identifying data in regard to the patient, information concerning the type of tests to be performed, space for the recording of the test results, and routing instructions, for example. Typically, the sheets in the pad are individually separable from a common end 60, such as along a perforated line 54 which extends through the pad.

Test tube type container 50 has a closure 56 which may be a screw-on lid as illustrated here, or a common stopper, snap-on type lid, etc. In use with a test tube type container 50 and order slip 52 described above, the release paper 28 is removed from the back 18 of first label element 10 and the adhesive portion 26 of the label element 10 wrapped around the body of the specimen container 50 such that the perforation line 30 overlies the demarcation line between the closure element 56 and the specimen tube body, here indicated by the bottom 58 of the screw-on closure 56. Identifying information, such as the patients name, may then be inscribed on the exposed front 16 of the first label element 10, if such has not been previously recorded thereon.

Second label element 12 is affixed to the order slip pad 52 by removing the release paper 42 from the adhesive portion 36, and then placing the second label element over the common end 60 of the order slip pad 52 by bending the second element longitudinally across crease line 44 and securing the now creased adhesive portion 36 to one side and then the other side of the pad 52 in a manner so as not to interfere with the removal of individual slips from the pad.

It will thus be seen that the first label element 10 closely conforms to the shape of the specimen container 50, with the more bulky order slip pad 52 mechanically connected to the container 50 but in spaced relation therefrom. This arrangement provided by the improved label of this invention thus permits the order slips to be set at any convenient location near the container or to otherwise hang loosely. This promotes orderly arrangement of specimen containers in an upright orientation, thereby substantially eliminating problems of leakage and spillage caused in transport of such containers labeled in accordance with the prior art.

Disassociation of the label elements 10 and 12 from each other is simply accomplished by tearing one or both label elements along perforation 24 and/or 40 to separate the adhesive portions from the non-adhesive portions. The inter-connecting thread member 14 may then be discarded.

With the first label element 10 affixed to the test-tube type container as described above, additional securing of the cap 56 to the tube body is achieved by virtue of the adhesive portion of the label being wrapped about both of these members. Removal of the cap 56 when desired is accomplished by first removing the non-adhesive portion 22 from the remainder of the label element 10, as by tearing along the perforated line 24. A simple twisting motion of the cap 56 thereupon serves to break the longitudinal perforation 30 which extends across the adhesive portion 20, the cap then being released.

The improved label of this invention can be provided in a pad-like form, that is, with the two label elements joined along common end with one label element upon the other. Some means, such as carbon paper, interposed between the stacked label elements serves to duplicate writing made on the uppermost label onto the face of the lower label element.

While the principles of this invention have been described above in connection with a specific preferred embodiment, it is to be clearly understood that this description is made only by way of example and not in limitation of the scope of the invention. For instance, while the invention has been illustrated as applied to the labeling of laboratory specimen containers it will be noted that the invention is applicable in any similar context where it is desired to mechanically associate identifying or documentary material with an item, such as a container, yet maintain the material spaced from the object to thereby facilitate storage and transport of the labeled item.

What is claimed is:

1. An improved unitary label for attaching a multi-leaf pad to a container comprising:

first and second label elements, the first label element having a front and a back, the back having an adhesive portion for affixing the first label element to the container, the second label element including means for affixing the second label element to the multi-leaf pad, and a flexible elongated member joining the first and second label elements in spaced apart relation when said elements are so affixed to the container and the multi-leaf pad.

2. The label of claim 1 wherein the first and second label elements are made of paper, the first label element having a front and back, the back having a contact adhesive portion, the back further including a non-adhesive portion and a removable release paper covering the contact adhesive portion.

3. The label of claim 2 wherein the means for joining the first and second label elements is an elongate non-rigid member having two ends, one of the ends being carried by the non-adhesive portion of the first label element and the other end carried by the second label element.

4. The label of claim 2 wherein the first label element has a first perforation extending along a line separating the adhesive portion from the non-adhesive portion.

5. The label of claim 4 wherein the container includes a cap having a top and a bottom, and wherein the first label element is generally rectangular in form, the first performation extending substantially parallel to two sides, and further including a second perforation extending substantially parallel to the other two sides and across the adhesive portion, the first label when wrapped around the container with the second perforation adjacent the bottom of the cap additionally securing the cap to the container, and permitting the cap to be removed by breaking the first label element along the second perforation.

6. An improved label for use with a container, such as a laboratory specimen container, and a plurality of papers joined together into a pad for separation at a common end, comprising:

a first label element, the first label element being generally two dimensional in form and having a front and back, the back having an adhesive portion, a second label element, the second label element being generally two dimensional in form and having a front and back, the back having an adhesive portion, means for interconnecting the first and second label elements in spaced apart relation, whereby the first label element can be adhesively secured to the common end of the pad and the second element can be adhesively secured to the container.

7. The label of claim 6 wherein the first and second label elements each further include a non-adhesive portion on the back, and wherein the adhesive portion is a contact adhesive, and further including a release-paper covering the adhesive portion, and wherein the interconnecting means is attached to the non-adhesive portions.

8. The label of claim 7 wherein the first and second label elements are each generally rectangular, and are provided with a perforation line extending along a length of the element and a second perforation line extending along a width, the perforation serving to divide each element into separable portions.

9. The label of claim 8 wherein the interconnecting means is elongate, thin and flexible.

10. The label of claim 9 wherein the interconnecting means is a strand of filamentous material having two ends, one end being fixed to the non-adhesive end of the first label element, the other end being fixed to the non-adhesive end of the second label element.

11. The label of claim 9 wherein the interconnecting means is elongate and resilient.

12. The label of claim 6 wherein the first and second label elements are stacked one upon the other and joined at a common end, the fronts of both label elements facing in the same direction, and further including means between said first and second label elements for reproducing an impression, such as writing, made on the exposed face of the uppermost label element on the face of the underlying label element.

13. The label of claim 8 wherein the label element are semi-rigid paper cards.

14. An improved label for use with a test tube type container having a cap type closure, and a plurality of papers joined together into a pad for separation at a common end, comprising:

a first label element, the first label element being generally two dimensional in form and having a front and back and a length and width, the back having an adhesive portion and a non-adhesive portion, the first label element further having a perforation line extending through the label element and along the width of the label element adjacent the non-adhesive portion, and a second perforation line extending through the label element and along the length of the label element at least over the non-adhesive portion and up to the width perforation, a second label element, the second label element being generally two dimensional in form and having a front and back, the back having an adhesive portion and a non-adhesive portion, and interconnecting means for the first and second label elements associating the first and second label elements in spaced apart relation, the interconnecting means being attached to the respective non-adhesive portions of the label elements, whereby the first label element can be adhesively secured to both the container and the cap in a manner that will secure the cap to the tube, and that will permit the cap to be removed by breaking the first label element along the lengthwise perforation.

15. An improved label for mechanically connecting identifying material to a container, comprising:

first and second label elements, means for joining the first and second label elements in spaced relation, the first and second label elements each having an adhesive portion and a non-adhesive portion, the means for joining the first and second label elements being associated with each of the non-adhesive ends, whereby the first label element can be adhesively secured to the container and the second label element adhesively secured to the identifying material.

16. The improved label of claim 15 wherein the joining means is elongate, thin and flexible.

17. The improved label of claim 16 wherein the first label element has a first perforation extending along a line separating the adhesive portion from the non-adhesive portion, and a second perforation extending substantially perpendicular to the first perforation and across the adhesive portion.

* * * * *

UNITED STATES PATENT AND TRADEMARK OFFICE

CERTIFICATE OF CORRECTION

PATENT NO. : 4,513,522

DATED : April 30, 1985

INVENTOR(S) : William M. Selenke

It is certified that error appears in the above-identified patent and that said Letters Patent is hereby corrected as shown below:

| | |
|---|---|
| Column 1 line 14 | "a" should be --as--. |
| Column 3 line 52 | "removable" should be --removal--. |
| Column 5 line 14 | Delete "the". |
| Column 6 line 16 | "patients" should be --patient's-- |
| Column 7 line 40 | "performation" should be --perforation--. |
| Column 8 line 29 | "element" should be --elements--. |

Signed and Sealed this

*Fifteenth* Day of *October 1985*

[SEAL]

*Attest:*

*Attesting Officer*

DONALD J. QUIGG

*Commissioner of Patents and Trademarks—Designate*